US007264209B2

(12) United States Patent
Burk

(10) Patent No.: US 7,264,209 B2
(45) Date of Patent: Sep. 4, 2007

(54) HAIR DRYER STAND

(76) Inventor: Lori Burk, 3850 Regent Dr., Dallas, TX (US) 75229

( * ) Notice: Subject to any disclaimer, the term of this patent is extended or adjusted under 35 U.S.C. 154(b) by 0 days.

(21) Appl. No.: 10/890,554

(22) Filed: Jul. 12, 2004

(65) Prior Publication Data

US 2006/0006294 A1 Jan. 12, 2006

(51) Int. Cl.
*A47G 23/02* (2006.01)
*A45D 20/12* (2006.01)

(52) U.S. Cl. ..... 248/146; 248/311.2; 248/311.3; 34/96; 34/239

(58) Field of Classification Search ..... 248/146, 248/671, 676, 519, 523, 94, 148, 152, 150, 248/311.2, 310, 311.3, 314; 34/90, 96, 239
See application file for complete search history.

(56) References Cited

U.S. PATENT DOCUMENTS 4,225,106 A * 9/1980 Eplan ..... 248/282.1
4,461,439 A * 7/1984 Rose ..... 248/51
4,696,447 A * 9/1987 Strecker ..... 248/206.3
4,874,142 A * 10/1989 Gelatt ..... 248/185.1
4,878,642 A * 11/1989 Kirby, Jr. ..... 248/311.2
D305,944 S * 2/1990 Mellott ..... D28/38
D318,393 S * 7/1991 Shea et al. ..... D7/619.1
5,090,649 A * 2/1992 Tipp ..... 248/176.2
D374,312 S * 10/1996 Edgar ..... D28/73
5,590,861 A * 1/1997 Ardolino ..... 248/146
5,613,305 A * 3/1997 Narrin ..... 34/90
5,636,815 A * 6/1997 Wilson ..... 248/125.9
5,765,792 A * 6/1998 Thomas ..... 248/121
5,853,158 A * 12/1998 Riggle ..... 248/311.2
6,109,581 A * 8/2000 Kracke et al. ..... 248/311.3
6,209,732 B1 * 4/2001 Dennis et al. ..... 211/70.6
6,457,686 B1 * 10/2002 Hill ..... 248/176.1
6,491,267 B1 * 12/2002 Feldman ..... 248/176.1
6,601,813 B1 * 8/2003 Kager et al. ..... 248/314
6,684,922 B1 * 2/2004 Alston et al. ..... 141/375

* cited by examiner

*Primary Examiner*—Anita M. King
(74) *Attorney, Agent, or Firm*—Law Office of Steven B. Leavitt, LLP; Steven B. Leavitt

(57) ABSTRACT

A hair dryer stand for setting an operating blow-dryer on a countertop without burning the countertop or material on the countertop. The hair dryer stand comprises at least one base, at least one side wall having a top and a bottom where the bottom is attached to the base, at least one vent, and an opening wherein the opening profile is defined by the top of the side wall and can receive the intake side of a blow-dryer that is turned on. In use, the blow-dryer is supported in the opening and suspended above the countertop. Air is allowed to flow into the intake side of the blow-dryer, over the heating coils inside blow-dryer and prevents the blow-dryer from overheating. Also, the exhaust side of the blow-dryer is directed upward, away from the countertop so the countertop or material on countertop will not burn.

14 Claims, 5 Drawing Sheets

HAIR DRYER STAND

BACKGROUND OF THE INVENTION

1. Technical Field

The present invention relates to the field of tool holders and, more particularly, to the area of holders for blow-dryers that retain blow-dryers in both operating and non-operating states.

2. Description of Related Art

Early hair dryers were large fixed appliances having a dome shaped hood under which a user would place their head. These devices, however, were cumbersome and could not be easily moved. In an attempt to provide mobility, manufacturers devised "portable" hair dryers. These, although moveable, were still bulky and difficult to transport. More recently, handheld hair dryers ("blow-dryers") were introduced.

Blow-dryers are much smaller, easier to pack and carry and are commercially available in an assortment of sizes, strengths, and types. These devices are electrically driven and provide electrical heaters for heating air drawn in through an intake, over heating coils, and then directed through an exhaust nozzle. Typical units are gun-shaped providing a handle which allows one to hold the dryer and direct its air flow at the hair. Thereby a user may dry and style her hair.

Typically, a blow-dryer is held in one hand while the other hand is used to style the hair with a brush or other styling instrument. However, since one hand must be used to hold the blow-dryer, a user only has one hand available to style their hair. Sometimes a user needs both of her hands to style her hair. As recommended by manufacturers, this involves turning the blow-dryer off, setting it down on a countertop, styling the hair, and then turning the blow-dryer back on to finish styling the hair. The blow-dryer should be turned off because if the blow-dryer is set on a countertop while operating, the air intake has a much greater time collecting enough air to pass over the electric heaters and the blow-dryer could overheat, cause a fire, and creates a hazard in that it may fall into a sink containing water. Also, the hot air blown out of the exhaust nozzle may burn the countertop or material on the countertop.

Often it is difficult to turn the blow-dryer back on while keeping the hair styled in the desired position to be blow dried. Users frequently need both hands free to style their hair. Turning the blow-dryer on and off is a step most users do not like to do and therefor will often fail to turn off the blow-dryer.

What is needed is a blow-dryer stand that enables the user to leave the blow-dryer on when styling a section of blow. The stand should allow the intake of the blow-dryer to draw in enough air to prevent the blow-dryer from overheating. The stand should also direct the exhaust nozzle away from the countertop so as not to burn the countertop or material on the countertop. It should be durable, relatively inexpensive, and easy to use.

SUMMARY OF THE INVENTION

The hair dryer stand of the present invention allows a user to set a blow-dryer (handheld hair dryer) on a countertop without having to turn the blow-dryer off. The blow-dryer stand can have many different profiles but each profile generally consists of at least one side wall, a vent, and an opening for receiving an end of a blow-dryer. The hair dryer stand may be made from any durable material including plastic, metal, ceramic, and combinations thereof which is relatively durable and inexpensive to manufacture. Preferably, the stand may be comprised of acrylic, polyethylene, polyethene, polyethylene glycol, high-density polyethylene, low density polyethylene. Also, because the hair dryer stand is a single unit with no moving parts or required fasteners the hair dryer stand is easy to use.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
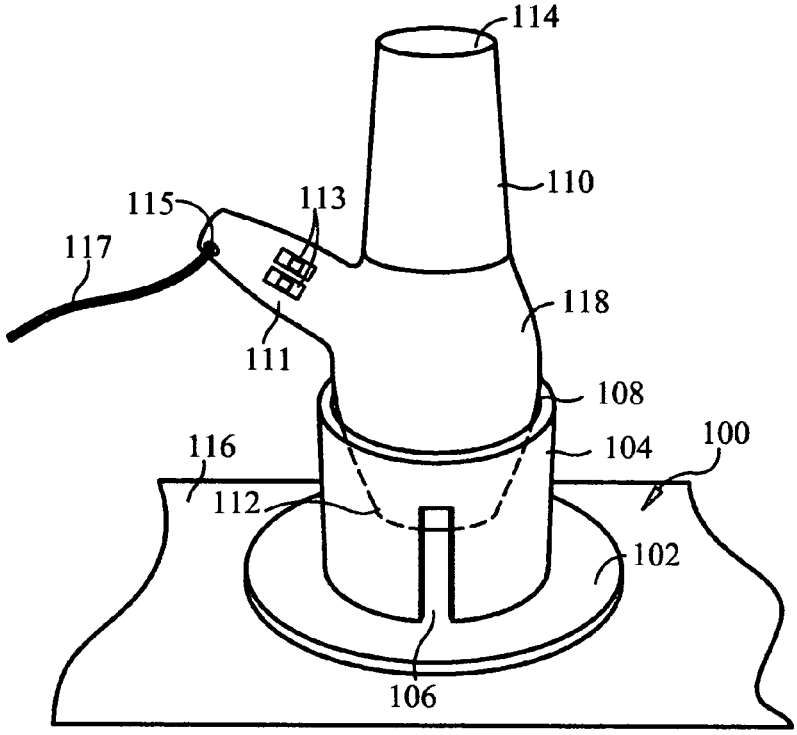
FIG. 1 is a plan view of a first embodiment of a tool holder in accordance with the present invention retaining a blow-dryer in a desired position.
Figure 2:
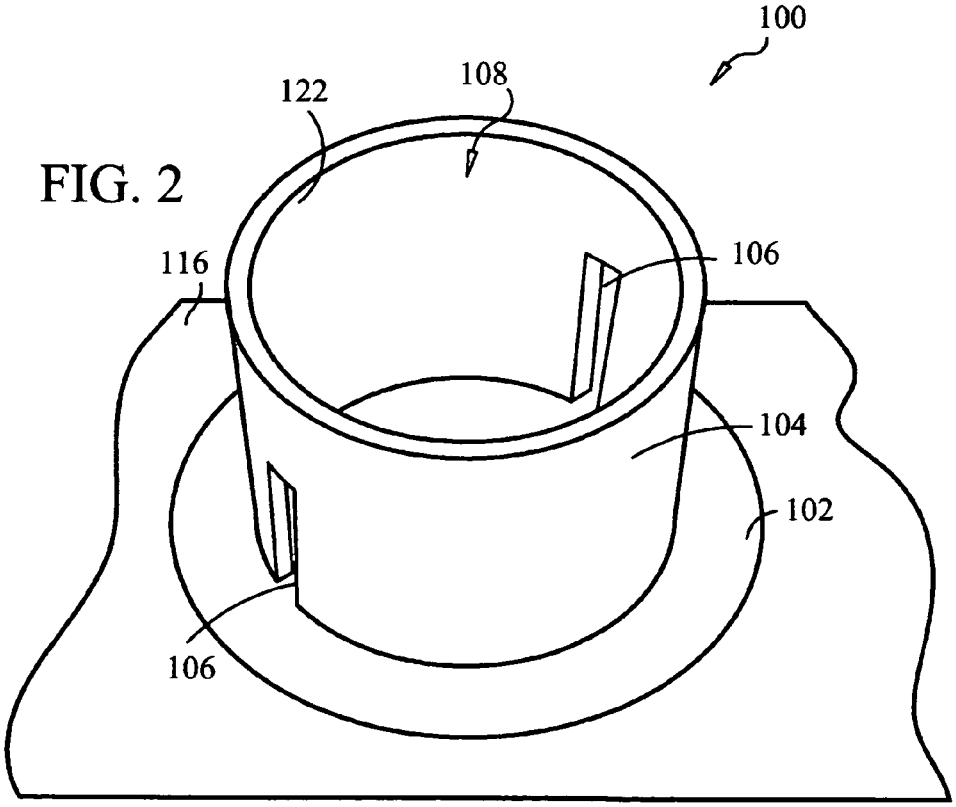
FIG. 2 is a perspective view of a first embodiment of a tool holder in accordance with the present invention.

FIGS. 1 and 2 depict one embodiment of hair dryer stand 100. FIGS. 1 and 2 depict optional base 102, side wall 104, vent 106, opening 108, and countertop 116. Base 102 and side wall 104 can be made of any material and may be made from any durable material including plastic, metal, ceramic, and combinations thereof which is relatively durable and inexpensive to manufacture. Preferably, the stand may be comprised of acrylic, polyethylene, polyethene, polyethylene glycol, high-density polyethylene, low density polyethylene, or some other similar material. Optional base 102 may have a square, triangle, rectangle, circle, oval, hexagon or any polygon shape and is about 3 to about 18 inches at the widest part and is large enough to prevent tipping when a commercially available blow-dryer is placed in opening 108. Base 102 is optional because in an embodiment not shown stand 100 is formed such that the width or diameter and the proportion of weight to height of stand 100 are sufficiently large enough to provide a center of gravity that is low enough to support the weight of numerous typical blow-dryers and not collapse. Side wall 104 is continuous and forms the shape of a square, triangle, rectangle, circle, oval, hexagon, or polygon. Inside wall 122 of side wall 104 defines opening 108.

Opening 108 extends the length of side wall 104 and may have a square, triangle, rectangle, circle, oval, hexagon, or polygon shape. Opening 108 is large enough to allow intake side 112 to pass through and is about 2 to about 6 inches at the widest part. Side wall 104 is fixedly attached to and extends about 4 to about 24 inches vertically from base 102. Countertop 116 is a typical countertop found in a bathroom, hair salon, or any other place people may style their hair. Base 102 rests on countertop 116. In the optional embodiment not utilizing a base, the lower edge of side wall 104 would rest on countertop 116 in place of base 102.

Hair dryer stand 100 is used with a commercially available blow-dryer 110 such as the YELLOWBIRD available from the Conair Corporation located in Stamford, CT, or the MIDNIGHT SILVER 2000 9190U available from the Revlon Corporation located in New York, N.Y. Blow-dryer 110 has an intake side 112 and an exhaust side 114 and is inserted into opening 108 such that intake side 112 is proximate to base 102. Design bulge 118 on blow-dryer 110 prevents blow-dryer 110 from touching base 102 and suspends blow-dryer 110 at least about 0.25 inches above base 102. Advantageously, hair dryer stand 100 leaves blow-dryer handle 111 accessible such that control 113 may be manipulated while blow-dryer 110 is resting in stand 100. Also, the design of stand 100 allows electrical cord 117 to extend from an electricity port 115 without interfering with the operation and use of hair dryer stand 100. For blow-dryers that do not have a design bulge, the handle of the blow-dryer prevents the blow-dryer from touching base 102.

By suspending blow-dryer 110 above base 102, air is allowed to flow into intake side 112 and over the heating coils inside blow-dryer 110. This prevents blow-dryer 110 from overheating, causing a fire, or falling into a sink containing water. Also, exhaust side 114 is directed upward, away from countertop 116 so countertop 116 or material on countertop 116 will not burn.

Vent 106 allows passage of air to opening 108 and further increases the flow of air to intake side 112 of blow-dryer 110. Vent 106 can be any shape that will permit sufficient airflow such as a triangle, circle, oval, hexagon, polygon, or any shape allowing sufficient airflow. Furthermore, the shape may appear be decorative and aesthetically pleasing while still providing the needed airflow to the blow-dryer intake. Vent 106 is located proximate to base 102 and is orientated to maximize the air flow to intake side 112 and prevent blow-dryer 110 from overheating. The height of vent 106 can be any height but is typically no longer than half the length of side wall 104. There may be multiple vents 106.

Figure 3:
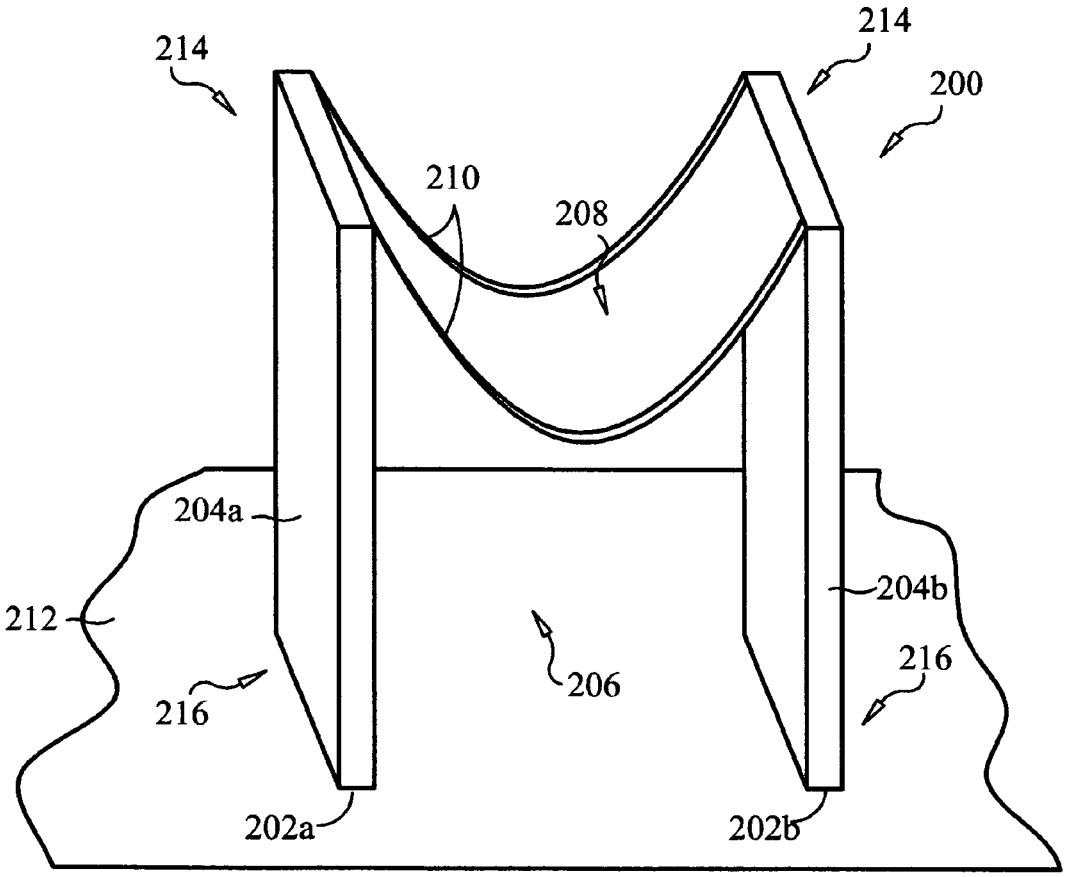
FIG. 3 is a perspective view of a second embodiment of a tool holder in accordance with the present invention.
Figure 4:
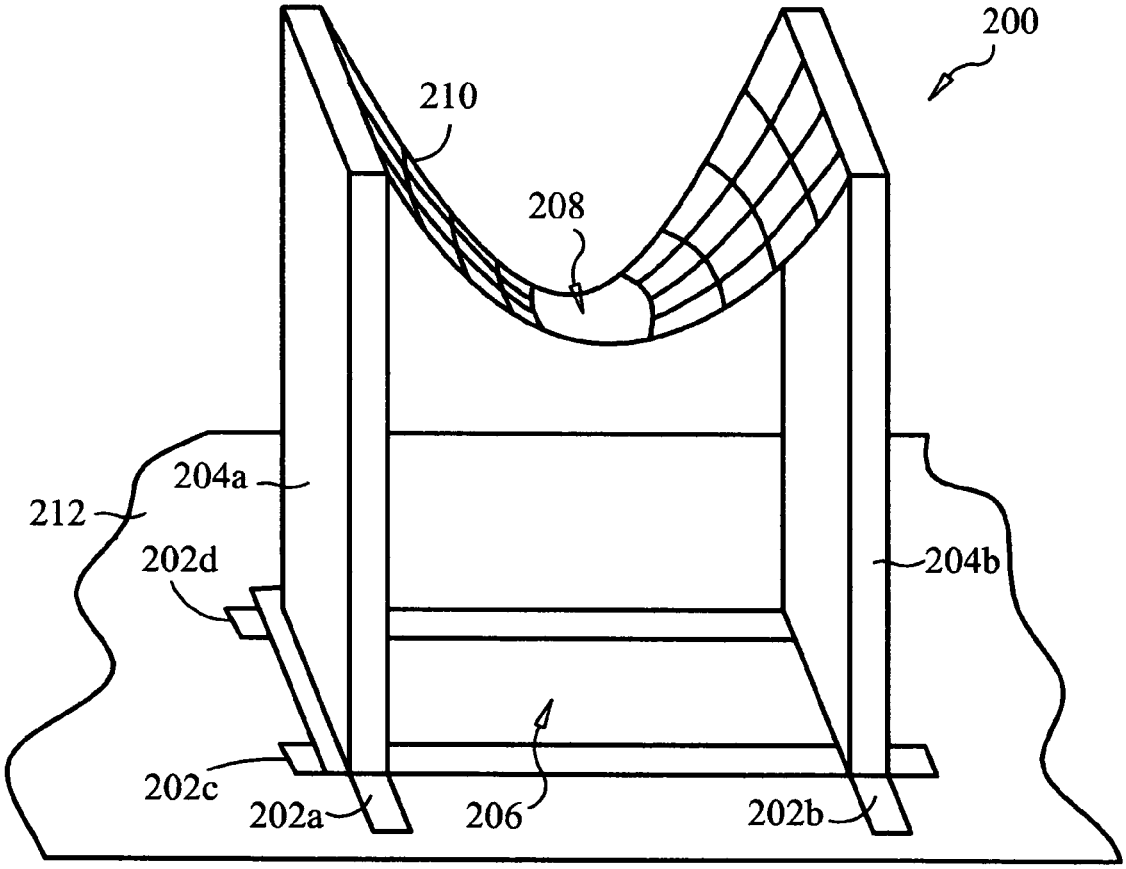
FIG. 4 is a perspective view of a third embodiment of a tool holder in accordance with the present invention.
Figure 5:
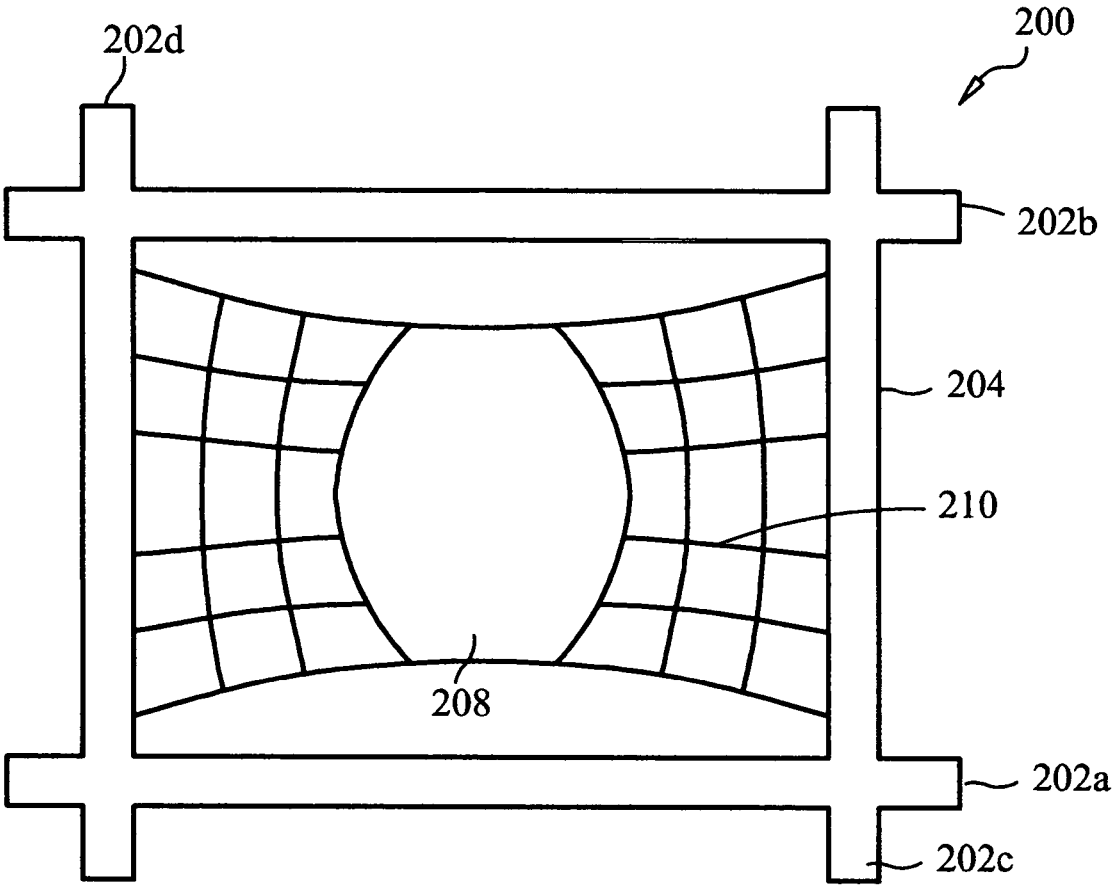
FIG. 5 is a bottom view of the tool holder shown in FIG. 4.

FIGS. 3, 4, and 5 depict one embodiment of hair dryer stand 200. FIG. 3 depicts base 202*a* and 202*b*, side wall 204*a* and 204*b*, vent 206, opening 208, bridge 210, and countertop 212. Base 202*a* and 202*b* and side wall 204*a* and 204*b* may be made of any material and may be made from any durable material including plastic, metal, ceramic, and combinations thereof which is relatively durable and inexpensive to manufacture. Preferably, the stand may be comprised of acrylic, polyethylene, polyethene, polyethylene glycol, high-density polyethylene, low density polyethylene, or some other similar material. Side wall 204*a* and 204*b* have a top 214 and a bottom 216. Base 202*a* and 202*b* are at the bottom 216 of side wall 204*a* and 204*b* respectively. Countertop 212 is a typical countertop found in a bathroom, hair salon, or any other place people may style their hair.

Side walls 204*a* and 204*b* are parallel to each other and supported by base 202*a* and 202*b*. Base 202*a* and 202*b* are in contact with and rest on countertop 212. Bridge 210 is fixedly attached to side wall 204*a* and 204*b* at top 214 and provides additional support for side walls 204*a* and 204*b*. Bridge 210 can be made of any material and may be made of acrylic, polyethylene, polyethene, polyethylene glycol, high-density polyethylene, low density polyethylene or some other similar rigid material as shown in FIG. 3 or heat resistant mesh, rope or cord as shown in FIGS. 4 and 5. If base 202*a* and 202*b*, side walls 204*a* and 204*b*, and bridge 210 are made of the same material, then hair drying stand 200 may be extruded as a single piece thereby making the manufacturing process relatively inexpensive.

Opening 208 may extend the length of bridge 210 as shown in FIG. 3, or may be a square, triangle, rectangle, circle as shown in FIGS. 4 and 5, oval, hexagon or any polygon. Opening 208 is large enough to allow the intake side of blow-dryer 110 to pass through and is about 2 to about 6 inches in diameter at the widest part.

In use, the blow-dryer 110 is inserted into opening 208 such that the intake side 112 is relatively proximate to countertop 212. Design bulge 118 on blow-dryer 110 prevents the blow-dryer 110 from touching countertop 212 and suspends blow-dryer 110 at least about 0.25 inches above countertop 212. For blow-dryers that do not have a design bulge, the handle of the blow-dryer prevents the blow-dryer from touching countertop 212.

FIGS. 4 and 5 depict hair dryer stand 200 having additional support base 202*c* and 202*d*. Addition support base 202*c* and 202*d* are parallel to each other and perpendicular to and on the same plane as base 202*a* and 202*b*.

By suspending blow-dryer 110 above countertop 212, air is allowed to flow into intake side 112, over the heating coils inside blow-dryer 110 and prevent blow-dryer 110 from overheating, causing a fire, or falling into a sink containing water. Also, exhaust side 114 is directed upward, away from countertop 212 so countertop 212 or material on countertop 212 will not burn. Vent 206 is defined by the space between side walls 204*a* and 204*b* and bridge 210 and allows for the flow of air into the intake side 112 of blow-dryer 110.

Figure 6:
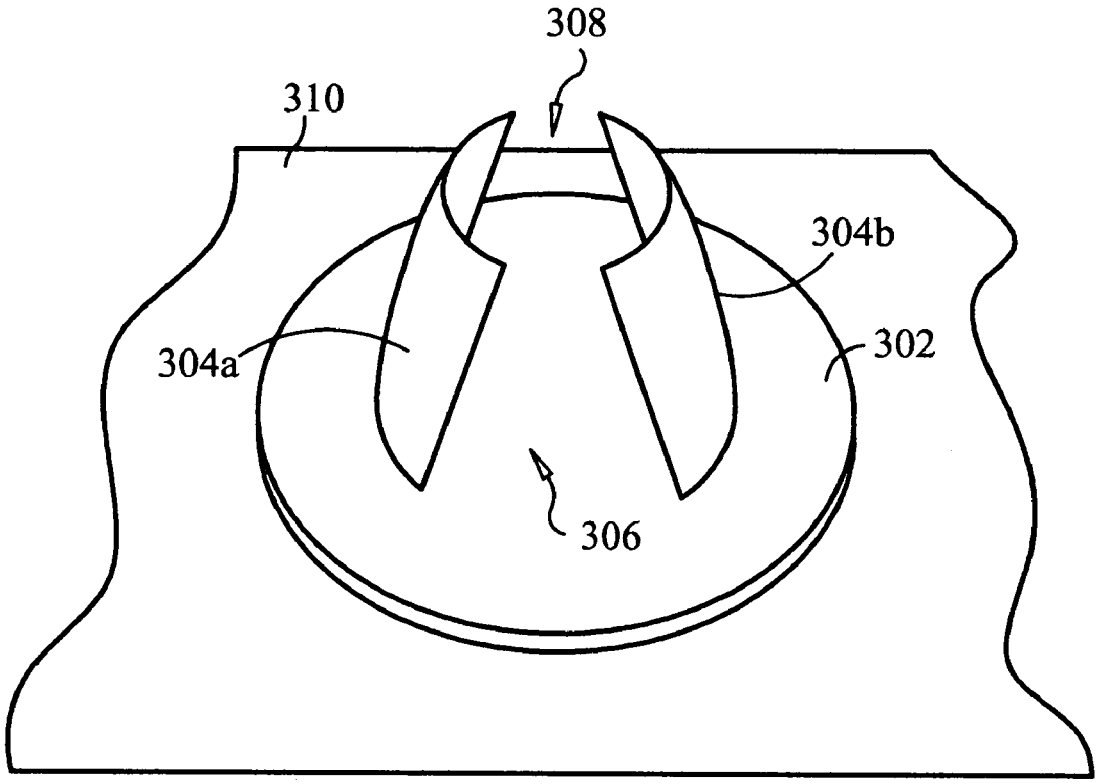
FIG. 6 is a perspective view of a fourth embodiment of a tool holder in accordance with the present invention.
Figure 7:
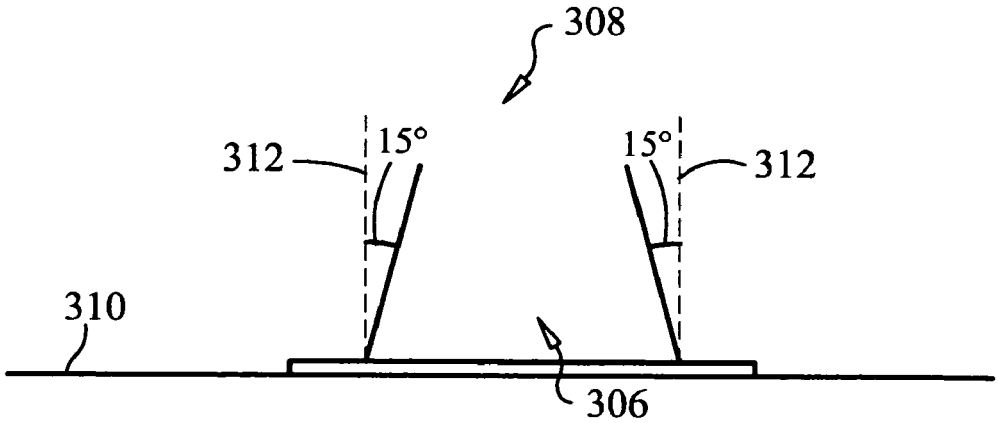
FIG. 7 is a cross sectional plan view of the tool holder shown in FIG. 6.

FIG. 6 is a perspective view and FIG. 7 is a cross-sectional plan view of one embodiment of the hair dryer stand. FIGS. 6 and 7 depict base 302, side walls 304*a* and 304*b*, vent 306, opening 308, and countertop 310. Base 302 and side wall 304 can be made of any material and may be made from any durable material including plastic, metal, ceramic, and combinations thereof which is relatively durable and inexpensive to manufacture. Preferably, the stand may be comprised of acrylic, polyethylene, polyethene, polyethylene glycol, high-density polyethylene, low density polyethylene, or some other similar material. Countertop 310 is a typical countertop found in a bathroom, hair salon, or any other place people may style their hair. Base 302 is in contact with and rests on countertop 310.

Side walls 304*a* and 304*b* extend upward from base 302 at an angle such that the ends of each side wall are converging to each other. While depicted as mirror images, side walls 304*a* and 304*b* do not need to be identical providing that they converge towards each other and can support at least a blow-dryer in the desired position. Side walls 304*a* and 304*b* may be round, oval, square, rectangular, triangular, hexagon or any other polygon. Side walls 304*a* and 304*b* may have a curved profile and are fixedly attached to and supported by base 302. In one embodiment, side wall 304*a* and 304*b* extend about 4 to about 24 inches vertically from base 302 at an angle from about 0 to about 4 to about 5 degrees relative to plane 312 which is perpendicular to base 302. See FIG. 7. For example, in one embodiment, as shown in FIG. 7, side wall 304*a* and 304*b* extend from base 302 at an angle of about 15 degrees relative to plane 312.

In use, the blow-dryer 110 is inserted into opening 308 such that the intake side 112 is relatively proximate to base 306. Opening 308 may be a square, triangle, rectangle, circle, oval, hexagon or any polygon shape and is defined by side wall 304*a* and 304*b*. Opening 308 is large enough to allow the intake side 112 of the blow-dryer 110 to pass through and is typically about 2 to about 6 inches at the widest part. The design bulge 118 on the blow-dryer 110 prevents the blow-dryer 110 from touching base 302 and suspends the blow-dryer 110 at least about 0.25 inches above base 302. For blow-dryers that do not have a design bulge, the handle of the blow-dryer prevents the blow-dryer from touching countertop 310.

By suspending the blow-dryer 110 above base 302, air is allowed to flow into the intake side 112, over the heating coils inside the blow-dryer 110 and prevent the blow-dryer 110 from overheating, causing a fire, or falling into a sink containing water. Vent 306 is defined by the space between side wall 304*a* and 304*b* and opening 308 and allows for the flow of air to the intake side 112 which prevents the blow-dryer 110 from overheating. Also, the exhaust side 114 is directed upward, away from countertop 310 so countertop 310 or material on countertop 310 will not burn.

For example, the hair dyer stand could be modified and used with other tools such as a curling iron, hair crimper, glue gun, soldering iron, or other such electronic devices having a relatively cool handle end and a relatively hot heat producing end that can produce temperatures over 125 degrees Fahrenheit. The modifications may include narrowing or widening the opening to accommodate holding the handle end of the desired tool such that the heat producing end is not proximate to a countertop or material on the countertop, increasing or decreasing the size or number of vents, increasing or decreasing the size of the base, or other such modifications which would prevent the tool from overheating, causing a fire, or falling into a sink or container of water.

While the invention has been particularly shown and described with reference to one or more preferred embodiments, it will be understood by those skilled in the art that various changes in form and detail may be made therein without departing from the spirit and scope of the invention.

What is claimed is:

1. A hair dryer stand for holding a blow-dryer that is turned on wherein the blow-dryer has an intake side and an exhaust side, the hair dryer stand comprising:

two side walls that are parallel to each other and extend perpendicularly from at least one base wherein at least one side wall is between about 4 to about 24 inches having a top and a bottom wherein the bottom is proximate to the at least one base and supports the hair dryer stand when positioned to receive the blow-dryer;

at least one vent proximate to at least one base which is proximate to the bottom;

an opening which extends from the base to the top of the side wall wherein the profile is defined by the top of the side wall, and further the opening is adapted to receive the air intake side of the blow-dryer; and a bridge interposed between the side walls.

2. The hair dryer stand of claim 1 wherein the at least one side wall is circular in shape.

3. The hair dryer stand of claim 1 wherein the at least one side wall is oval in shape.

4. The hair dryer stand of claim 1 wherein the at least one base is circular in shape.

5. The hair dryer stand of claim 1 wherein the at least one base is about 3 to about 18 inches in diameter.

6. The hair dryer stand of claim 1 wherein the at least one vent is proximate to the bottom of the side wall.

7. The hair dryer stand of claim 1 wherein the at least one vent extends from the at least one base to the opening.

8. The hair dryer stand of claim 1 wherein the opening is about 2 to about 6 inches across.

9. The hair dryer stand of claim 1 wherein the bridge and side walls are made of acrylic, polyethylene, polyethene, polyethylene glycol, high-density polyethylene, or low density polyethylene.

10. The hair dryer stand of claim 1 wherein the bridge is made of heat resistant mesh, rope or cord.

11. The hair dryer stand of claim 1 wherein the side walls are at about a 0 to 45 degree angle relative to a plane perpendicular to the base.

12. The hair dryer stand of claim 1 further comprising the base adjacent to a terminal end of the bottom of the side wall wherein the base is an opening bounded by a peripheral edge of the terminal end of the bottom of the side wall.

13. The hair dryer stand of claim 1 wherein the vent allows sufficient passage of air into an interior portion of the hair dryer stand to allow continuous operation of a hair dryer.

14. The hair dryer stand of claim 1 further comprising the base adjacent to a terminal end of the bottom of the side wall wherein the base is a planar surface.

* * * * *